US008043015B1

(12) United States Patent
Bledsoe et al.

(10) Patent No.: US 8,043,015 B1
(45) Date of Patent: Oct. 25, 2011

(54) DETECTING EDGE OF A PRINT MEDIUM WITH A HANDHELD IMAGE TRANSLATION DEVICE

(75) Inventors: James D. Bledsoe, Corvallis, OR (US); Asher Simmons, Corvallis, OR (US); James Mealy, Corvallis, OR (US); Patrick A. McKinley, Corvallis, OR (US); Gregory F. Carlson, Corvallis, OR (US); Todd A. McClelland, Corvallis, OR (US)

(73) Assignee: Marvell International Ltd., Hamilton (BM)

( * ) Notice: Subject to any disclaimer, the term of this patent is extended or adjusted under 35 U.S.C. 154(b) by 909 days.

(21) Appl. No.: 11/968,558

(22) Filed: Jan. 2, 2008

Related U.S. Application Data

(60) Provisional application No. 60/883,112, filed on Jan. 2, 2007.

(51) Int. Cl.
*B41J 3/36* (2006.01)

(52) U.S. Cl. ..... 400/88; 400/279

(58) Field of Classification Search ..... 400/88, 400/279

See application file for complete search history.

(56) References Cited

U.S. PATENT DOCUMENTS

| | | | | |
|---|---|---|---|---|
| 3,359,425 | A * | 12/1967 | Smith | 250/222.1 |
| 5,927,872 | A * | 7/1999 | Yamada | 400/88 |
| 6,259,826 | B1 * | 7/2001 | Pollard et al. | 382/284 |
| 6,357,939 | B1 * | 3/2002 | Baron | 400/88 |
| 6,952,880 | B2 * | 10/2005 | Saksa | 33/35 |
| 7,246,958 | B2 * | 7/2007 | Saund et al. | 400/88 |
| 7,591,166 | B2 * | 9/2009 | Ueda et al. | 73/9 |
| 2004/0109034 | A1 * | 6/2004 | Brouhon | 346/143 |
| 2007/0009277 | A1 * | 1/2007 | Shoen | 399/82 |

* cited by examiner

*Primary Examiner* — Anthony H. Nguyen

(57) ABSTRACT

Systems, apparatuses, and methods for a handheld image translation device configured to detect an edge of a target print medium to prevent unintended deposition of a printing substance are described herein. The handheld image translation device, which may be a printing device, may include a print head, a position module, and a print module. The print head may be configured to deposit one or more printing substances onto a first surface such as a target print surface. The position module may be configured to receive data from navigation sensors indicating a first surface characteristic of the first surface, and to determine whether at least a portion of the print head is positioned over a second surface having a second surface characteristic different from the first characteristic, wherein the determination is made by detecting a characteristic other than the first surface characteristic as indicated by data received from the navigation sensors.

16 Claims, 7 Drawing Sheets

DETECTING EDGE OF A PRINT MEDIUM WITH A HANDHELD IMAGE TRANSLATION DEVICE

CROSS-REFERENCES TO RELATED APPLICATIONS

The present application claims priority to U.S. Patent Application No. 60/883,112, filed Jan. 2, 2007, entitled "Sensing Print Media for Hand-Held Printer," the entire disclosure of which is hereby incorporated by reference in its entirety for all purposes.

TECHNICAL FIELD

Embodiments of the present invention relate to the field of image translation and, more particularly, to determining positioning of a handheld image translation device relative to a print medium.

BACKGROUND

Traditional image translation devices including multifunction devices (e.g., print/fax/copy/scan devices) and single function devices, such as printing devices, rely on a mechanically operated carriage to transport a print head in a linear direction as other mechanics advance a print medium in an orthogonal direction. As the print head moves over the print medium an image may be laid down. Portable printers have been developed through technologies that reduce the size of the operating mechanics. However, the principles of providing relative movement between the print head and print medium remain the same as traditional printing devices. Accordingly, these mechanics limit the reduction of size of the printer as well as the material that may be used as the print medium.

Handheld image translation devices such as handheld printing devices have been developed that ostensibly allow an operator to manipulate the handheld device over a print medium in order to print an image onto the medium. However, these devices are challenged by the unpredictable and nonlinear movement of the device by the operator. The variations of operator movement, including rotation of the device itself, make it difficult to determine the precise location of the print head. This type of positioning error may have deleterious effects of the quality of the printed image.

Another issue that may arise when such handheld devices are used is the problem of unintentional or untended deposition of printing substances onto a surface other than the surface of the target print medium. That is, with conventional handheld devices, the current approach for determining the edge or boundary of the target print medium is to rely on users' own judgment to make such determinations. This may be a less than ideal solution for preventing the printing device from accidentally moving off the print medium and dispensing printing substances, such as, for example, ink, onto surfaces other than the surface of the target print medium.

For example, if the target print medium is a sheet of paper that has been placed on a table top, the user of such a handheld printing device could easily and unintentionally slide the printing device beyond the boundaries of the paper. This may result in the accidental and unintended deposition of the printing substance onto the underlying table top. This may be a particularly troublesome issue, for example, when the image to be created is bigger than the paper since the device will continue to dispense the printing substance even after the device has moved off the print medium. Thus, it may be particularly advantageous to have a handheld image translation device that can automatically determine the edge or the boundaries of the print medium.

SUMMARY

At least some embodiments of the present invention are based on the technical problem of providing a handheld image translation device, such as a printing device, that may detect the edge of the target print medium and prevent unintended deposition of a printing substance onto a surface other than the targeted print surface during, for example, a printing operation. More specifically, there is provided, in accordance with various embodiments of the present invention, an apparatus including, among other things, a print head, a position module, and a print module that work cooperatively together to prevent unwanted deposition of printing substances, such as, for example, ink, onto surfaces other then a targeted print surface. In particular, the print head may be configured to deposit one or more printing substances onto a first surface, while the position module may be configured to receive data from navigation sensors indicating a first surface characteristic of the first surface. The position module may further be configured to determine whether at least a portion of the print head is positioned over a second surface having a second surface characteristic different from the first surface characteristic, wherein the determination is by detecting a characteristic other than the first surface characteristic as indicated by data received from the navigation sensors.

Meanwhile, the print module may be configured to control the print head to deposit the one or more printing substances onto the first surface in accordance with image data received from an image source, and to suspend, at least temporarily, deposition of at least a portion of the one or more printing substances based on a determination made by the position module that the at least a portion of the print head is positioned over the second surface, to prevent the portion of the one or more printing substances from being deposited onto the second surface.

In some embodiments, the first surface characteristic may be first surface structural variations of the first surface and the second surface characteristic may be second surface structural variations of the second surface. For these embodiments, the position module may be further configured to detect structural variations other than the first surface structural variations in the data.

In some embodiments, the navigation sensors include one or more optical navigation sensors to provide a first surface image of the first surface showing the first surface structural variations of the first surface. For these embodiments, the position module may be further configured to detect structural variations other than the first surface structural variations in a second surface image provided by the one or more optical navigation sensors.

In some embodiments, the one or more optical navigation sensors may include a first and a second optical sensor that are disposed at the print head. For these embodiments, the handheld image translation device may further include a main housing coupled to the print head, and the one or more optical navigation sensors may further include a third optical sensor disposed at the main housing. When the third optical sensor is included with the handheld image translation device, the position module may be further configured to determine a translation and a rotation of the handheld image translation device relative to a reference location on the first surface using the third optical sensor. For these embodiments, the position module may be further configured to determine the reference location using the third optical sensor.

In some embodiments, the print head may include a plurality of nozzles disposed on a surface of the print head configured to deposit the one or more printing substances onto the first surface. For these embodiments, the print head may have a proximal end and a distal end opposite the proximal end, the proximal end being coupled to the main housing, and the nozzles being disposed along the surface of the print head between the proximal and distal ends, and the first and the second optical sensor being disposed at the distal end of the print head adjacent to the nozzles and on opposite sides of the nozzles.

In some embodiments, the navigation sensors may include one or more tactile sensors to provide the first and second data.

In some embodiments, the print head may include a plurality of nozzles configured to deposit the one or more printing substances. For these embodiments, the print module may be further configured to control selected ones of the nozzles to suspend, at least temporarily, the deposition of the at least a portion of the one or more printing substance based on a determination made by the position module that the at least a portion of the print head is positioned over the second surface, to prevent the at least a portion of the one or more printing substance from being deposited onto the second surface. Further, the position module may be further configured to, after determining that the at least a portion of the print head is positioned over the second surface, determine whether the at least a portion of the print head is back over the first surface. In addition, the print module may be further configured to control the selected ones of the nozzles to resume the deposition of the at least a portion of the one or more printing substances based on a determination made by the position module that the at least a portion of the print head is back over the first surface.

These and other features of various embodiments of the present invention are described in greater detail herein.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

In the following detailed description, reference is made to the accompanying drawings which form a part hereof wherein like numerals designate like parts throughout, and in which are shown, by way of illustration, specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Reference in the specification to "one embodiment" or "an embodiment" means that a particular feature, structure, or characteristic described in connection with the embodiment is included in at least one embodiment. The appearances of the phrase "in one embodiment" in various places in the specification do not necessarily all refer to the same embodiment, but they may.

The phrase "A and/or B" means (A), (B), or (A and B). The phrase "A, B, and/or C" means (A), (B), (C), (A and B), (A and C), (B and C) or (A, B and C). The phrase "(A) B" means (A B) or (B), that is, A is optional.

Figure 1:
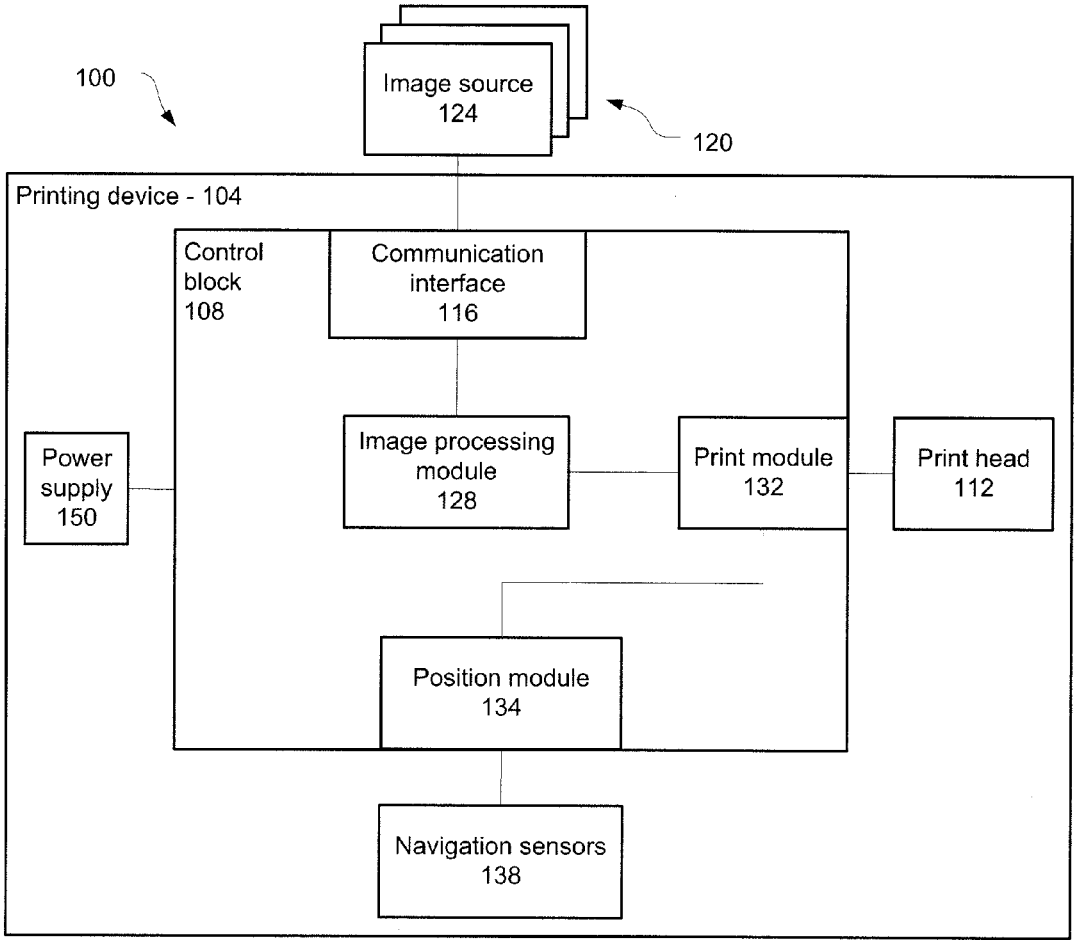
FIG. 1 is a schematic of a system including a handheld printing device in accordance with various embodiments of the present invention.

FIG. 1 is a schematic of a system 100 including a handheld printing device 104 in accordance with various embodiments of the present invention. The printing device 104 may be a handheld image translation device that may be a single function printing device or a multifunction device (e.g., print/fax/copy/scan device). The printing device 104 may include a control block 108 with components designed to facilitate determination of edges or boundaries of a print medium as well as precise and accurate positioning of a print head 112 throughout an entire printing operation. This positioning and edge detection may allow the printing device 104 to reliably produce an image on a surface of the targeted print medium using a truly mobile and versatile platform without unintentionally printing onto other surfaces as will be explained herein.

The control block 108 may include a communication interface 116 configured to communicatively couple the control block 108 to other devices 120, which may include an image source 124. The image source 124 may be any type of device capable of transmitting data related to an image to be printed. The image source 124 may include a general purpose computing device, e.g., a desktop computing device, a laptop computing device, a mobile computing device, a personal digital assistant, a cellular phone, etc. or it may be a removable storage device, e.g., a flash memory data storage device, designed to store data such as image data. If the image source 124 is a removable storage device, e.g., a universal serial bus (USB) storage device, the communication interface may include a port, e.g., USB port, designed to receive the storage device.

The communication interface 116 may include a wireless transceiver to allow the communicative coupling with the image source 124 to take place over a wireless link. The image data may be wirelessly transmitted over the link through the modulation of electromagnetic waves with frequencies in the radio, infrared or microwave spectrums.

A wireless link may contribute to the mobility and versatility of the printing device 104. However, some embodiments may additionally/alternatively include a wired link communicatively coupling one or more of the other devices 120 to the communication interface 116.

In some embodiments, the communication interface 116 may communicate with the other devices 120 through one or more wired and/or wireless networks including, but not limited to, personal area networks, local area networks, wide area networks, metropolitan area networks, etc. The data transmission may be done in a manner compatible with any of a number of standards and/or specifications including, but not limited to, 802.11, 802.16, Bluetooth, Global System for Mobile Communications (GSM), code-division multiple access (CDMA), Ethernet, etc.

The communication interface 116 may transmit the received image data to an on-board image processing module 128. The image processing module 128 may process the received image data in a manner to facilitate an upcoming printing process. Image processing techniques may include dithering, decompression, half-toning, color plane separation, and/or image storage. In various embodiments some or all of these image processing operations may be performed by the image source 124 or another device. The processed image may then be transmitted to a print module 132 where it is cached in anticipation of a print operation.

In order to determine the position (i.e., location and orientation) of the printing device 104 during, for example, a printing operation, the print module 132 may receive positioning information indicative of a position of the print head 112 relative to a reference location on the print medium, as well as information indicative of the print head 112 relative to the boundaries or edges of the print medium from a position module 134.

The position module 134 may be communicatively coupled to one or more navigation sensors 138, which may provide positioning data used by the position module 134 to determine the position information provided to the print module 132. The navigation sensors 138 may also provide data to be used by the position module 134 to determine whether at least a portion of the print head 112 is over a surface other than the surface of the target print medium (herein "print surface" or "target print surface"). By providing such information to the print module 132, the print module 132 may control the print head 112 to suspend, at least temporarily, at least a portion of the printing substance (e.g., ink) being deposited by the print head 112 during a printing operation as will be described herein.

In some embodiments, the navigation sensors 138 may include one or more optical navigation sensors comprising a light source, e.g., light-emitting diode (LED), a laser, etc., and an optoelectronic sensor designed to take a series of pictures of a print surface adjacent to the printing device 104 as the printing device 104 is being moved over the target print medium during a printing operation.

In order to determine the position of the printing device 104 using the optical navigation sensors, the position module 134 may process pictures provided by the optical navigation sensors to detect structural variations of the print surface. The movement of the structural variations as shown in successive pictures may indicate motion of the printing device 104 relative to the medium. Tracking this relative movement may facilitate determination of the precise positioning of the navigation sensors 138. The navigation sensors 138 may be maintained in a structurally rigid relationship with the print head 112, thereby allowing for the calculation of the precise location of the print head 112.

In some alternative embodiments, the navigation sensors 138 may include tactile navigation sensors rather than or in addition to the optical navigation sensors described above. For these embodiments, the tactile navigation sensors may be used in a similar manner as the optical navigation sensors described herein. For example, the tactile sensors may be used to detect the structural variation of the surface of the target print medium (herein "print surface"), and to provide to the print module 132 positioning data that indicate the structural variations of the print surface.

The position module 134 may also use the navigation sensors 138 to determine whether the print head 112 has moved off or partially moved off the target print surface and onto other surfaces. By detecting when at least a portion of the print head 112 is over surfaces other than the target print surface, printing onto untargeted surfaces may be averted. In order to do so, the navigation sensors 138 may initially provide data indicating a characteristic of the target print surface. This characteristic may be relatively unique to the target print surface, thus allowing the position module 134 to distinguish the target print surface from other surfaces that may have characteristics different than those of the target print surface.

To illustrate, in the case where the navigation sensors 138 include optical navigation sensors, the printing device 104 may be initially placed over the targeted print surface. During this initial stage, the data provided by the navigation sensors 138 may be in the form of a picture or image of the target print surface. Such an image may show structural variations of the targeted print surface. The specific structural variations, which may show specific patterns of the print surface, may then be used by the position module 134 to distinguish between the target print surface and other surfaces having structural variations that may be different from the structural variations of the target print surface.

As a result, during a printing operation, the navigation sensors 138 may be used by the position module 134 to determine when a characteristic different than the identified characteristic of the target print surface is present based on the data provided by the navigation sensors 138. Data from the navigation sensors 138 showing the presence of a characteristic other than the characteristic of the print surface may indicate to the position module 138 the presence of surfaces other than the target print surface in the vicinity of (e.g., below) the print head 112.

For example, in the above embodiments where optical navigation sensors are employed, the navigation sensors 138 may initially provide, during a printing operation, a picture or pictures (i.e., data) of the target print surface. If the target print medium is a paper sheet, for example, and the sheet is lying on top of a table top, then the structural variations of the target print surface may be the specific weave pattern of the paper fibers. As will be further described herein, once the position module 134 has identified the particular characteristic of the target print surface (e.g., structural variations of the print surface), it may use the determined characteristic of the target print surface to distinguish the target print surface from other surfaces (e.g., the table top).

That is, during the printing operation, the position module 134 may monitor the data provided by the navigation sensors 138 to detect the presence of structural variations other than the structural variations of the target print surface. The presence of structural variations other than the structural variations of the target print surface as detected by the position module 134 may mean that at least a portion of the print head 112 is positioned over a surface other than the target print surface.

After the position module 134 determines the presence of the structural variations other than the structure variations of the target print surface, it may provide such a determination to the print module 132. Based on the determination, the print module 132 may then control the print head 112 to suspend, at least temporarily, deposition of at least a portion of the one or more printing substances being dispensed by the print head 112. On the other hand, once the position module 134 determines that the print head 112 has moved back entirely over the target print surface based on the absence of structural variations other than the structural variations of the target print surface, the print module 132 may then be notified of such a determination. The print module 132, in turn, may allow the print head 112 to fully resume its dispensation of the one or more printing substances onto the target print surface.

Note that in alternative embodiments, other characteristics may be used in order to detect the presence of a surface other than the target print surface in the vicinity of the print head 112. For example, the particular color variations or pigmentation of the target print surface may be used in order to detect the presence or absence of other surfaces.

The print medium, as used in embodiments herein, may be any type of medium on which a printing substance, e.g., ink, powder, etc., may be deposited. It is not limited to print paper or other thin, flexible print media commonly associated with traditional printing devices.

When the navigation sensors 138 include optical navigation sensors, the optical navigation sensors may have operating characteristics sufficient to track movement of the printing device 104 with the desired degree of precision. In one example, the optical navigation sensors may process approximately 2000 frames per second, with each frame including a rectangular array of 30×30 pixels. Each pixel may detect a six-bit interference pattern value, e.g., capable of sensing 64 different levels of patterning.

The print head 112 may be an inkjet print head having a plurality of nozzles designed to emit liquid ink droplets. The ink, which may be contained in reservoirs or cartridges, may be black and/or any of a number of various colors. A common, full-color inkjet print head may have nozzles for cyan, magenta, yellow, and black ink. Other embodiments may utilize other printing techniques, e.g., toner-based printers such as laser or LED printers, solid ink printers, dye-sublimation printers, inkless printers, etc.

The printing device 104 may include a power supply 150 coupled to the control block 108. The power supply 150 may be a mobile power supply, e.g., a battery, a rechargeable battery, a solar power source, etc. In other embodiments the power supply 150 may additionally/alternatively regulate power provided by another component (e.g., one of the other devices 120, a power cord coupled to an alternating current (AC) outlet, etc.).

Figure 2:
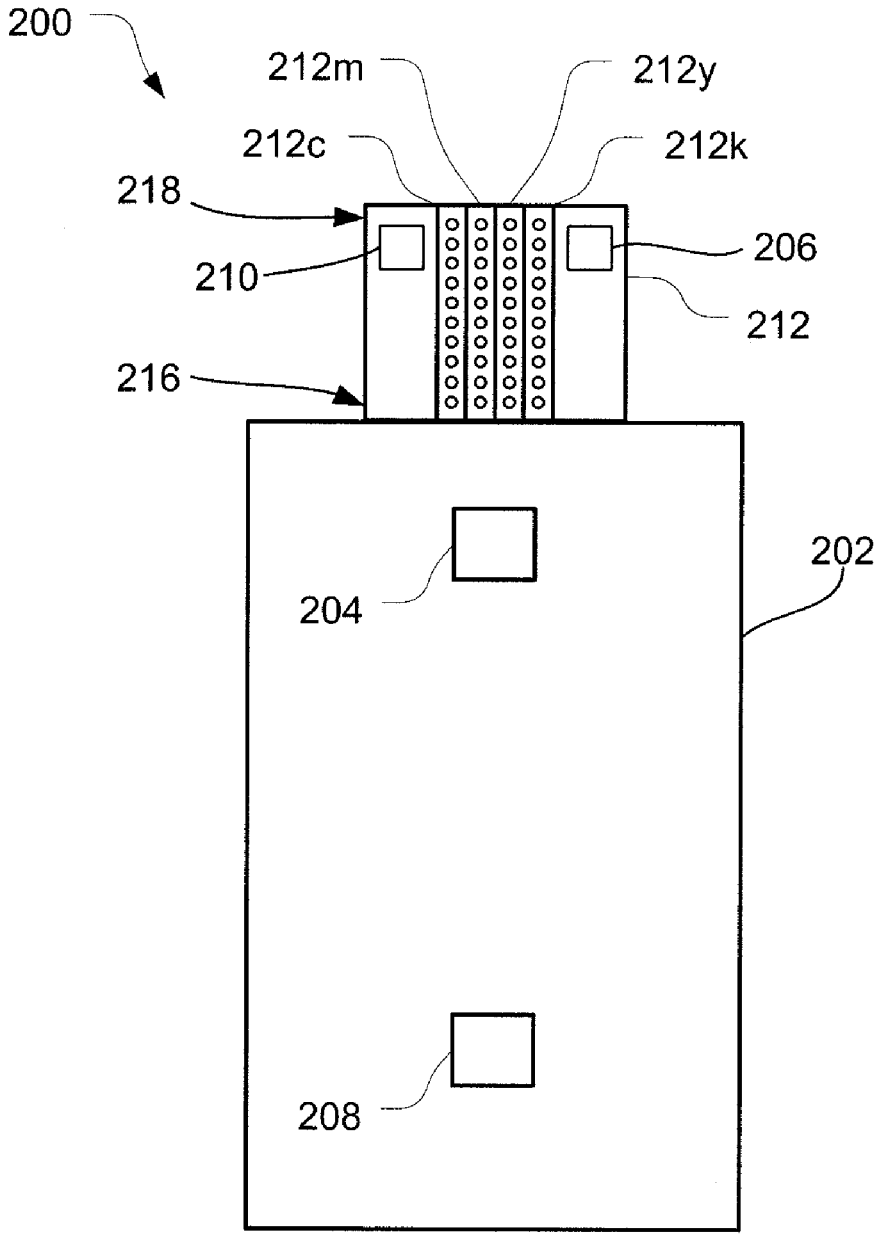
FIG. 2 is a bottom plan view of a handheld printing device in accordance with various embodiments of the present invention.

FIG. 2 is a bottom plan view of a printing device 200 in accordance with various embodiments of the present invention. The printing device 200, which may be a handheld image translation device, may be substantially interchangeable with printing device 104. As depicted, the printing device 200 may have a main housing 202 coupled to a print head 212. The main housing 202 may include a first navigation sensor 204 and a second navigation sensor 208, while the print head 212 may include a third navigation sensor 206 and a fourth navigation sensor 208. The print head 212 may have a proximal end 216 that is coupled to the main housing 202 and a distal end 218 opposite of the proximal end 216.

The navigation sensors 204 and 208 may be used by a position module, e.g., position module 134, to determine positioning information related to the print head 212. As stated above, the proximal relationship of the print head 212 to the navigation sensors 204 and 208 may be fixed to facilitate the positioning of the print head 212 through information obtained by the navigation sensors 204 and 208. One or more of the navigation sensors 202, 204, 206, and 208 may be used by the position module 134, individually or in combination, to determine the presence of a surface other than the target print surface in the vicinity of the print head 212. In particular, the position module 134 may use the navigation sensors 202, 204, 206, and 208 to determine whether at least a portion of the print head 112 is over a surface other than the target print surface during a printing operation.

In various embodiments, the navigation sensors 204 and 208 may be used in order to set a reference location on the target print surface. The referenced location, in brief, may be used to determine the position of the printing device 200 relative to the print medium as will be described in greater detail herein.

The print head 212 may be an inkjet print head having a number of nozzle rows for different colored inks. In particular, and as shown in FIG. 2, the print head 212 may have a nozzle row 212*c* for cyan-colored ink, a nozzle row 212*m* for magenta-colored ink, a nozzle row 212*y* for yellow-colored ink, and nozzle row 212*k* for black-colored ink.

While the nozzle rows 212*c*, 212*m*, 212*y*, and 212*k* shown in FIG. 2 are arranged in rows according to their color, other embodiments may intermix the different colored nozzles in a manner that may increase the chances that an adequate amount of appropriate colored ink is deposited on the print medium through the natural course of movement of the printing device 200 over the print medium.

During a printing operation, the print module 132 may control the nozzles of the print head 212 to deposit one or more printing substances (e.g., different color ink) onto the target print surface in accordance with the processed image data. When the position module 134 determines that at least a portion of the print head 212 is over a surface other than the target print surface, the print module 132, based on the determination made by the position module 134, may control one or more of the nozzles to suspend, at least temporarily, the deposition of at least a portion of the one or more printing substances that was or were designated by the image data to be disposed by the nozzles. In doing so, the portion of the one or more printing substances is prevented from being deposited onto the other surface.

If the position module 134 subsequently determines that the print head 212 is no longer over the other surface and is instead, positioned entirely over the target print surface, the print module 132 may control the one or more of the nozzles to resume deposition of the portion of the one or more printing substances onto the target print surface.

It should be noted that in alternative embodiments, additional navigation sensors may be disposed on the printing device 200 to better detect the presence of other surfaces other than the target print surface in the vicinity of the print head 112. For example, additional navigation sensors may be disposed on the print head 112 to supplement the two navigation sensors 206 and 210 depicted. For these embodiments, the additional navigation sensors may be placed in locations surrounding the nozzles. Further, in some alternative embodiments, the nozzles may be disposed on the main housing 202 of the printing device 200 rather than on a print head 212. For such embodiments, the navigation sensors may be disposed around the nozzles in order to detect the presence of surfaces other than the target print surface in the vicinity of the nozzles (e.g., below the nozzles)

Figure 3:
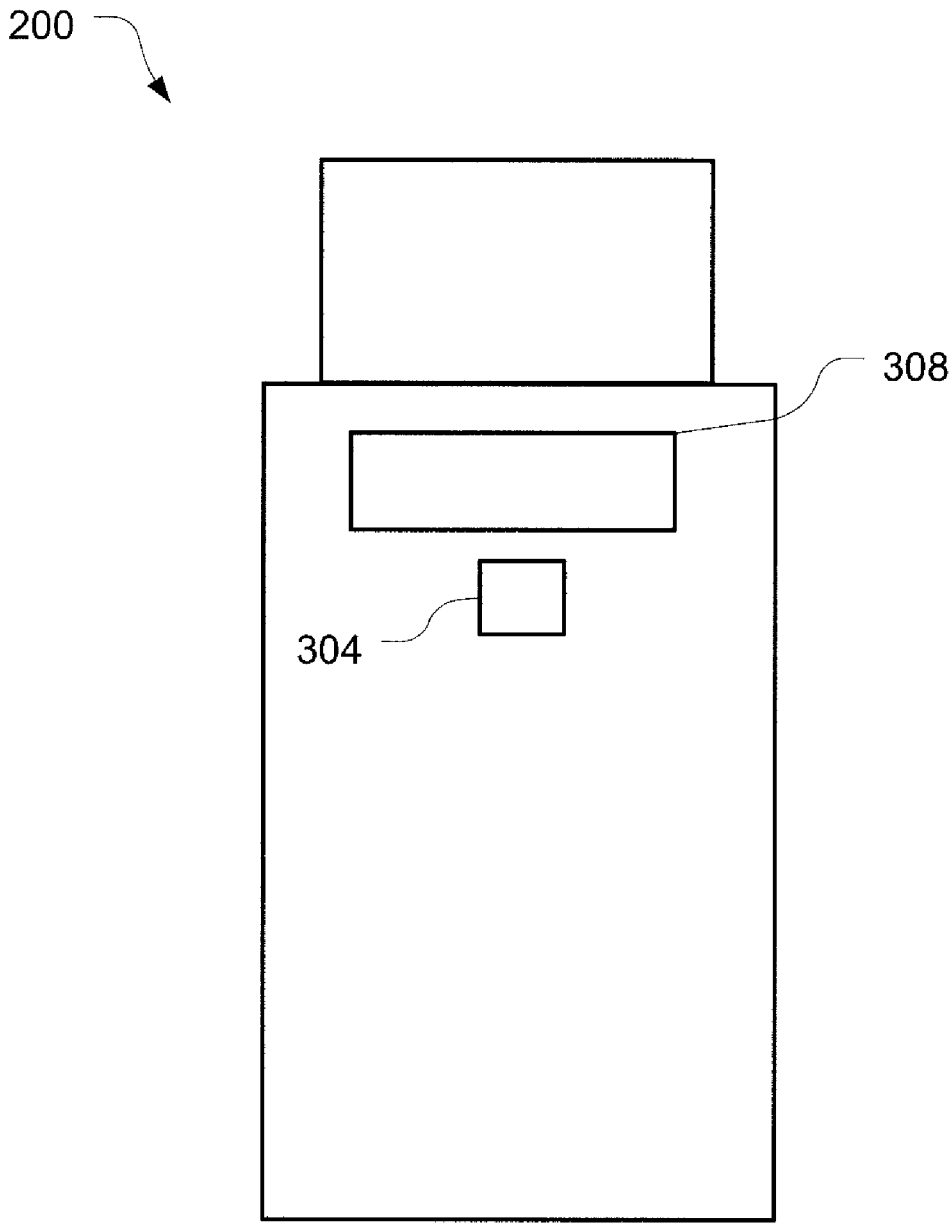
FIG. 3 is a top plan view of a printing device in accordance with various embodiments of the present invention.

FIG. 3 is a top plan view of the printing device 200 in accordance with various embodiments of the present invention. The printing device 200 may have a variety of user input/outputs to provide the functionality enabled through use of the printing device 200. Some examples of input/outputs that may be used to provide some of the basic functions of the printing device 200 include, but are not limited to, a print control input 304 to initiate/resume a print operation and a display 308.

The display 308, which may be a passive display, an interactive display, etc., may provide the user with a variety of information. The information may relate to the current operating status of the printing device 200 (e.g., printing, ready to print, receiving print image, transmitting print image, etc.), power of the battery, errors (e.g., positioning/printing error, etc.), instructions (e.g., "place printing device on print medium prior to initiating printing operation," etc.). If the display 308 is an interactive display it may provide a control interface in addition to, or as an alternative from, the print control input 304.

Figure 4:
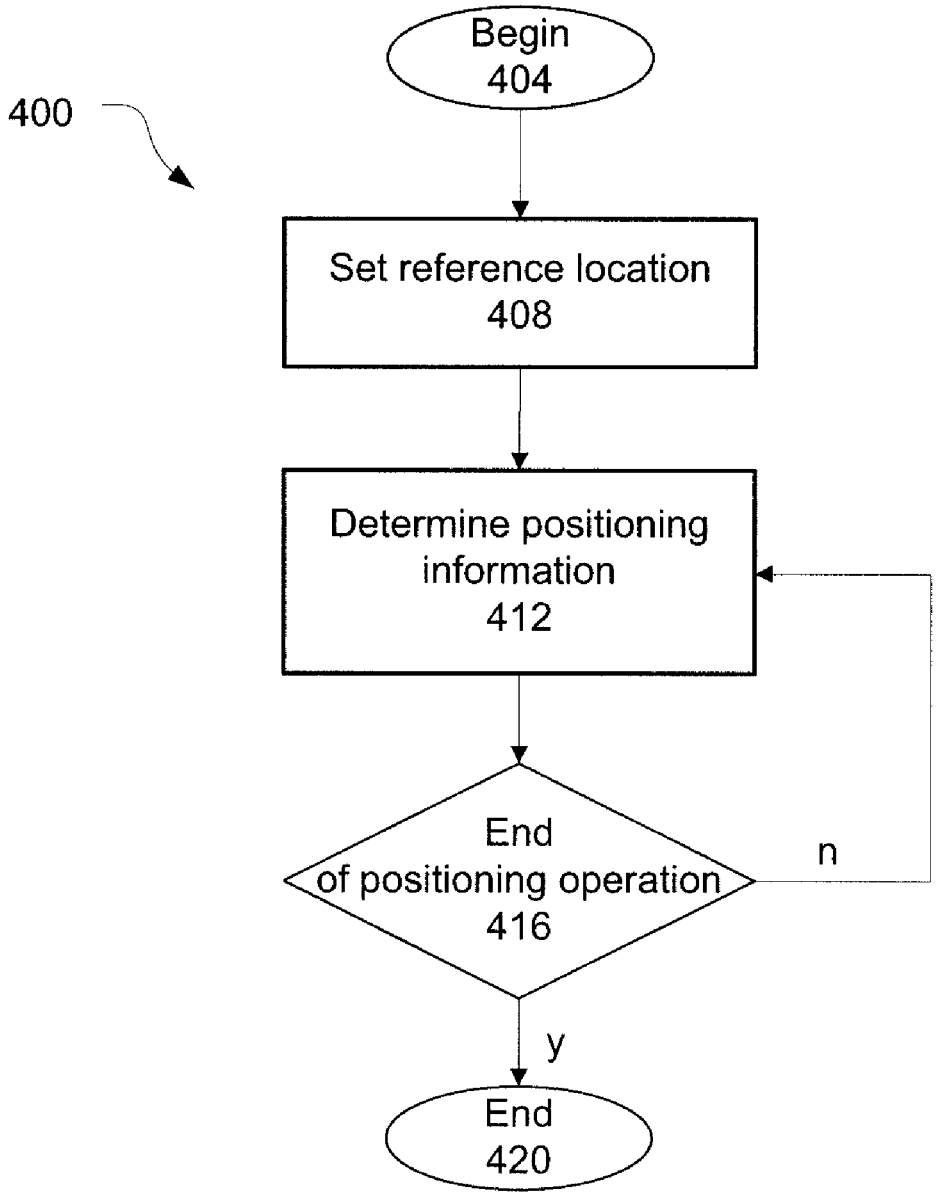
FIG. 4 is a flow diagram depicting a positioning operation of a handheld printing device in accordance with various embodiments of the present invention.

FIG. 4 is a flow diagram 400 depicting a positioning operation of the printing device 200 in accordance with various embodiments of the present invention. Note that the above described operations for determining the presence of a surface other than the target print surface in the vicinity of the print head 212, and the operations for consequently suspending depositions of printing substances based on the determination, may be executed complementarily with the positioning operation of FIG. 4. A positioning operation may begin at block 404 with an initiation of a printing operation, e.g., by activation of the print control input 304. A position module within the printing device 200 may set a reference location at block 408. The reference location may be set when the printing device 200 is placed onto a print medium at the beginning of a print job. This may be ensured by the user being instructed to activate the print control input 304 once the printing device 200 is in place and/or by the proper placement of the printing device 200 being treated as a condition precedent to instituting the positioning operation. In some embodiments the proper placement of the printing device 200 may be automatically determined through the navigation sensors 204 and/or 208 and/or some other sensors (e.g., a proximity sensor).

Once the reference location is set at block 408, the position module may determine positioning information, e.g., translational and rotational changes from the reference location, using the navigation sensors 204 and 208 at block 412. The translational changes may be determined by tracking incremental changes of the positions of a navigation sensor along a two-dimensional coordinate system, e.g., $\Delta x$ and $\Delta y$. Rotational changes may refer to changes in the angle of the printing device 200, e.g., $\Delta\Theta$, with respect to, e.g., the y-axis of the print media. These transitional and/or rotational changes may be determined by the position module comparing consecutive navigational images taken by the navigation sensors 204 and 208 to detect these movements. This process may be further explained by reference to FIG. 5 and corresponding discussion.

Figure 5:
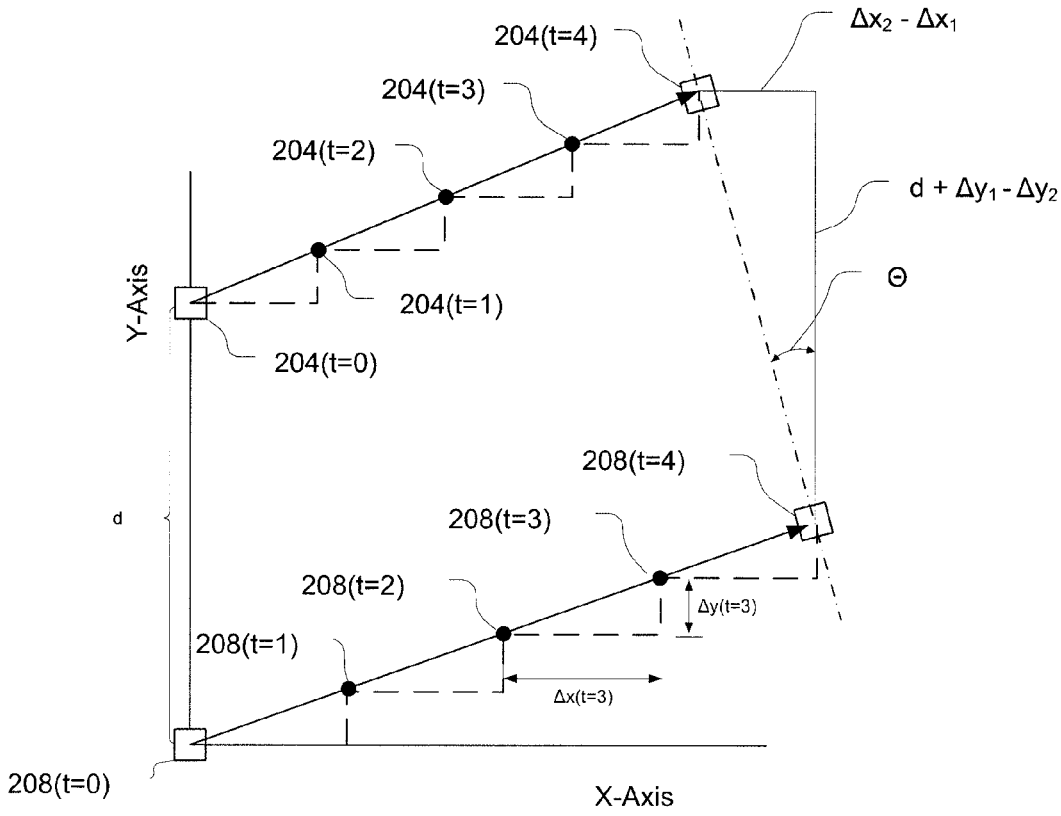
FIG. 5 is a graphic depiction of a positioning operation of a handheld printing device in accordance with various embodiments of the present invention.

FIG. 5 is a graphic depiction of a positioning operation of the printing device 200 in accordance with embodiments of the present invention. At initiation, e.g., t=0, the sensors 204 and 208 may be in an initial position indicated by 204 (t=0) and 208 (t=0), respectively. Over successive time intervals, e.g., t=1-4, the sensors 204 and 208 may be moved to an end position indicated by 204 (t=4) and 208 (t=4), respectively. As used in description of this embodiment, the "initial position" and the "end position" are used merely with reference to this particular operation and not necessarily the start or end of the printing operation or even other positioning operations.

As the sensors 204 and 208 are moved, they may capture navigational images at each of the indicated time intervals, e.g., t=0-4. The capture period may be synchronized between the sensors 204 and 208 by, e.g., hardwiring together the capture signals transmitted from the position module. The capture periods may vary and may be determined based on set time periods, detected motion, or some other trigger. In some embodiments, each of the sensors 204 and 208 may have different capture periods that may or may not be based on different triggers.

The captured navigational images may be used by the position module to determine a translation of the printing device 200 relative to a reference location, e.g., the sensors 204 (t=0) and 208 (t=0) as well as a rotation of the printing device 200. In some embodiments, the translation of the device 200 may be determined by analyzing navigational images from a first sensor, e.g., sensor 204, while the rotation of the device 200 may be determined by analyzing navigational images from a second sensor, e.g., sensor 208. In particular, and in accordance with some embodiments, the rotation of the printing device 200 may be determined by comparing translation information derived from the navigational images provided by sensor 208 to translation information derived from navigational images provided by sensor 204. Determining both the translation and the rotation of the printing device 200 may allow the accurate positioning of all of the nozzles of the print head 212.

The translation of the sensors 204 and 208 may be determined within the context of a coordinate system, e.g., a Cartesian coordinate system. In particular, the translation values may be determined for two-dimensions of the coordinate system, e.g., the x-axis and the y-axis as shown in FIG. 5. For example, the position module may accumulate the incremental $\Delta x$'s and $\Delta y$'s between successive time periods in order to determine the total translation of the sensors 204 and 208 from time zero to time four. The accumulated changes for sensor 204 may be referred to as $\Delta x_1$ and $\Delta y_1$ and the accumulated changes for sensor 208 may be referred to as $\Delta x_2$ and $\Delta y_2$. The sensors 204 and 208 may be a fixed distance d from one another.

The movement recorded by the sensors is relative to the sensor body. This illustration shows it being pinned down to the paper space. As the body of the system is rotated a movement of $\Delta x$ in the space of the system is effectively a movement of $\Delta x$ and $\Delta y$ in the frame of the paper.

The movement of the system that contributes to the rotation is that movement along a track that is perpendicular to the line that connects the two sensors separated by distance d.

Each sensor will report a different distance along this track much like the wheels of a car when it turns. The outside wheel will travel further. The rotation of the system with respect to the world or paper coordinate system is proportional to the difference between accumulated distance traveled along that perpendicular track for the two sensors.

The rotation $\Theta$ of the printing device 200 may then be determined by the following equation:

$$\theta = (\Sigma(\Delta 1 * \psi) - \Sigma(\Delta 2 * \psi))/d \quad \text{Eq. 1}$$

where $\psi$ is the unit vector perpendicular to the line connecting the two sensors

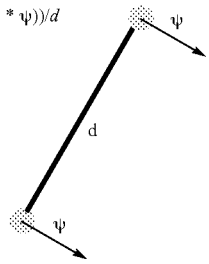

In designing the printing device 200, the distance d may be established based at least in part on the desired resolution of the data output from the sensors 204 and 208. For example, if the sensors 204 and 208 have a resolution of approximately 1600 counts per inch, the distance d may be approximately two inches.

Referring again to FIG. 4, following position determination at block 412, the position module may determine whether the positioning operation is complete at block 416. If it is determined that the positioning operation is not yet complete, the operation may loop back to block 412. If it is determined that it is the end of the positioning operation, the operation may end in block 420. The end of the positioning operation may be tied to the end of the printing operation, which will be discussed with reference to FIG. 6.

Figure 6:
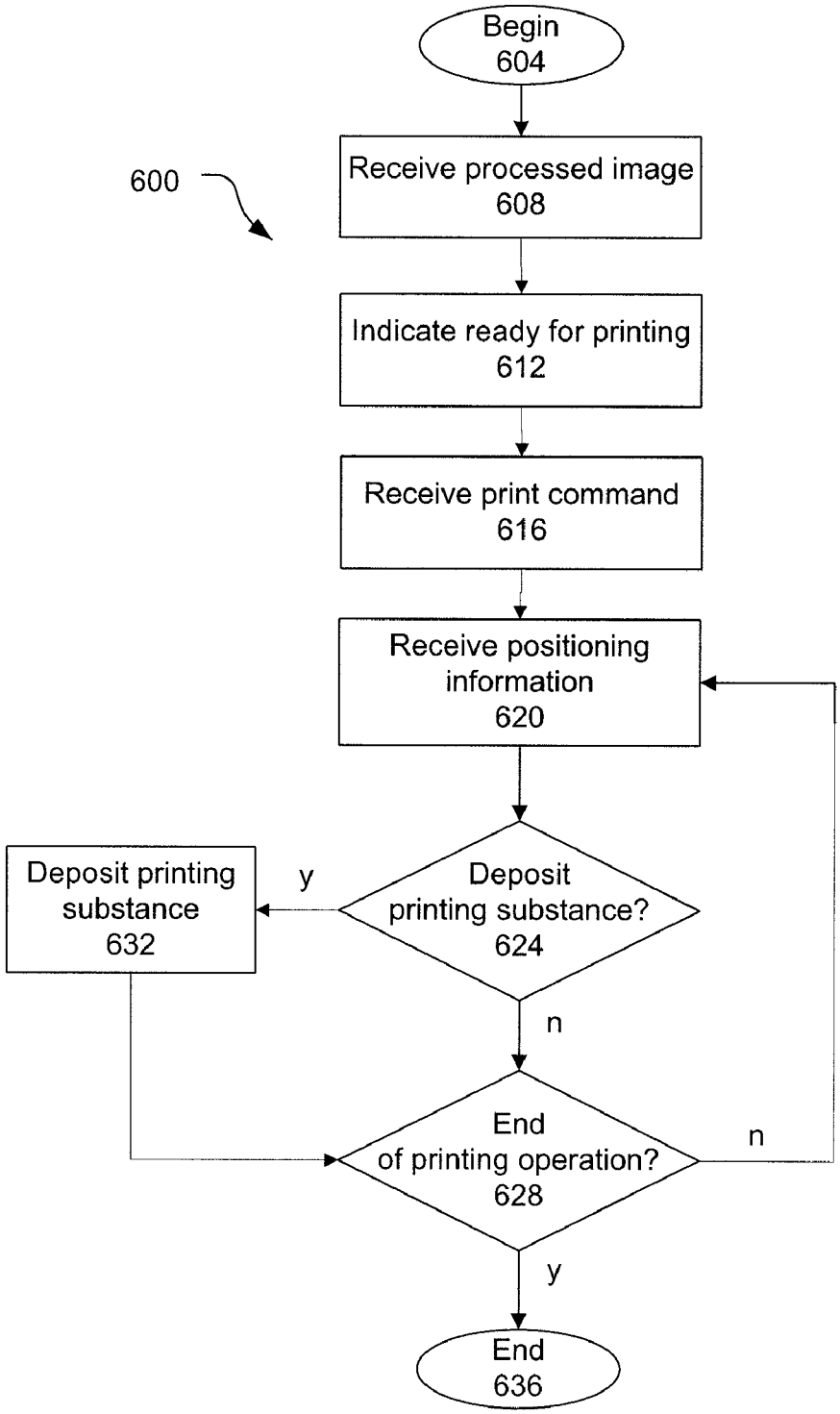
FIG. 6 is a flow diagram depicting a printing operation of a handheld printing device in accordance with various embodiments of the present invention.

FIG. 6 is a flow diagram 600 depicting an overall printing operation of the printing device 200 in accordance with various embodiments of the present invention. For ease of illustration and simplicity, the printing operation, which begins at block 604, excludes the operations for detecting a surface other than the target print surface and the operations for suspending depositions of printing substances described previously. The print module may receive a processed image from the image processing module at block 608. Upon receipt of the processed image, the display 308 may indicate that the printing device 200 is ready for printing at block 612.

The print module may receive a print command generated from a user activating the print control input 304 at block 616. The print module may then receive positioning information from the position module at block 620. The print module may then determine whether to deposit printing substance at the given position at block 624. The determination as to whether to deposit printing substance may be a function of the total drop volume for a given location and the amount of volume that has been previously deposited.

If it is determined that no additional printing substance is to be deposited at block 624, the operation may advance to block 628 to determine whether the end of the print operation has been reached. If it is determined that additional printing substance is to be deposited at block 624, the print module may cause an appropriate amount of printing substance to be deposited at block 632 by generating and transmitting control signals to the print head that cause the nozzles to drop the printing substance.

As can be seen, the position module's determination of the translation and rotation of the printing device 200 is done prior to the print module controlling the print head to deposit a printing substance. In order for the positioning information to remain relevant to the print determination, it may be desirable that the determination of the positioning information may take place as soon as possible after the acquisition of the navigational images upon which it is based. Accordingly, the translation and rotation calculations may be done in real time based on data accumulated up to that point. The rotation calculations are not determined retroactively based on a comprehensive accumulation of translation and image data as is done in prior art scanning devices discussed above.

The determination of whether the end of the printing operation has been reached at block 628 may be a function of the total printed volume versus the total anticipated print volume. In some embodiments the end of the printing operation may be reached even if the total printed volume is less than the total anticipated print volume. For example, an embodiment may consider the end of the printing operation to occur when the total printed volume is ninety-five percent of the total anticipated print volume. However, it may be that the distribution of the remaining volume is also considered in the end of print analysis. For example, if the five percent remaining volume is distributed over a relatively small area, the printing operation may not be considered to be completed.

In some embodiments, an end of print job may be established by a user manually cancelling the operation.

If, at block 628, it is determined that the printing operation has been completed, the printing operation may conclude at block 636.

If, at block 628, it is determined that the printing operation has not been completed, the printing operation may loop back to block 620.

Figure 7:
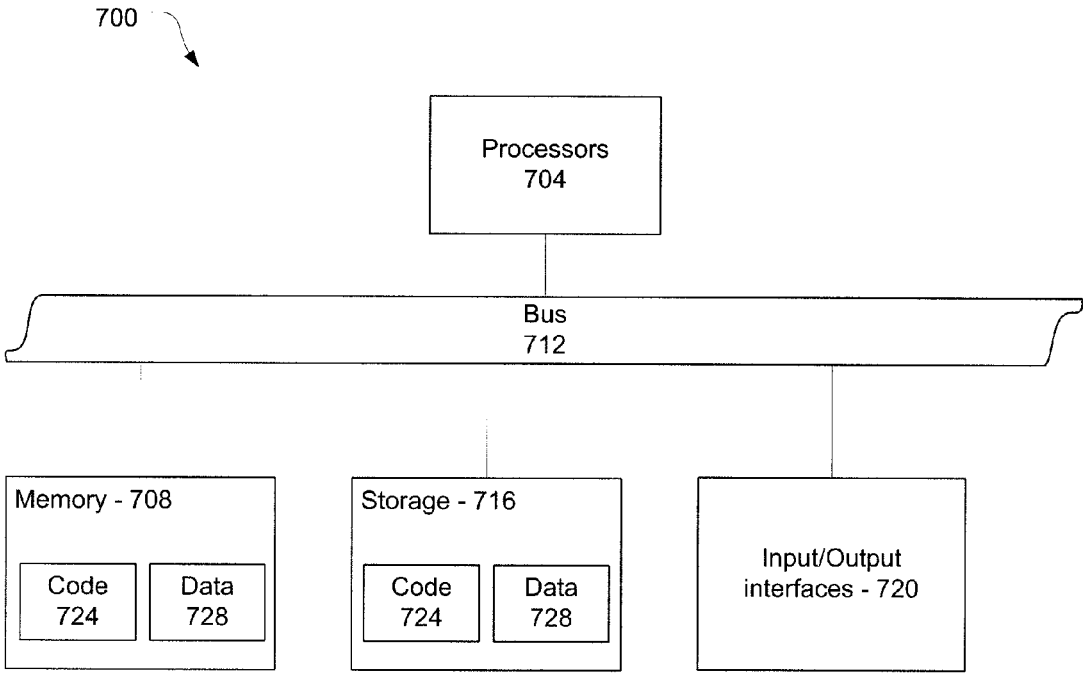
FIG. 7 illustrates a computing device capable of implementing a control block of a handheld printing device in accordance with various embodiments of the present invention.

FIG. 7 illustrates a computing device 700 capable of implementing a control block, e.g., control block 108, in accordance with various embodiments. As illustrated, for the embodiments, computing device 700 includes one or more processors 704, memory 708, and bus 712, coupled to each other as shown. Additionally, computing device 700 includes storage 716, and one or more input/output interfaces 720 coupled to each other, and the earlier described elements as shown. The components of the computing device 700 may be designed to provide the printing and/or positioning functions of a control block of a printing device as described herein.

Memory 708 and storage 716 may include, in particular, temporal and persistent copies of code 724 and data 728, respectively. The code 724 may include computer readable programming instructions that when accessed by the processors 704 result in the computing device 700 performing operations as described in conjunction with various modules of the control block in accordance with embodiments of this invention. The processing data 728 may include data to be acted upon by the instructions of the code 724. In particular, the accessing of the code 724 and data 728 by the processors 704 may facilitate printing and/or positioning operations as described herein.

The processors 704 may include one or more single-core processors, multiple-core processors, controllers, application-specific integrated circuits (ASICs), etc.

The memory 708 may include random access memory (RAM), dynamic RAM (DRAM), static RAM (SRAM), synchronous DRAM (SDRAM), dual-data rate RAM (DDRRAM), etc.

The storage 716 may include integrated and/or peripheral storage devices, such as, but not limited to, disks and associated drives (e.g., magnetic, optical), USB storage devices and associated ports, flash memory, read-only memory (ROM), non-volatile semiconductor devices, etc. Storage 716 may be a storage resource physically part of the computing device 700 or it may be accessible by, but not necessarily a part of, the computing device 700. For example, the storage 716 may be accessed by the computing device 700 over a network.

The I/O interfaces 720 may include interfaces designed to communicate with peripheral hardware, e.g., print head 112, navigation sensors 138, etc., and/or remote devices, e.g., other devices 120.

In various embodiments, computing device 700 may have more or less elements and/or different architectures.

Although specific embodiments have been illustrated and described herein, it will be appreciated by those of ordinary skill in the art and others, that a wide variety of alternate and/or equivalent implementations may be substituted for the specific embodiment shown and described without departing from the scope of the present invention. This application is intended to cover any adaptations or variations of the embodiment discussed herein. Therefore, it is manifested and intended that the invention be limited only by the claims and the equivalents thereof.

What is claimed is:

1. A handheld image translation (IT) apparatus, comprising:

a print head configured to deposit one or more printing substances onto a first surface;

multiple navigation sensors;

a position module configured to receive data from the multiple navigation sensors indicating a first surface characteristic of the first surface, and determine whether at least a portion of the print head is positioned over a second surface having a second surface characteristic different from the first surface characteristic by detecting a characteristic other than the first surface characteristic as indicated by data received from the multiple navigation sensors; and a print module configured to control the print head to deposit the one or more printing substances onto the first surface in accordance with image data received from an image source, and suspend, at least temporarily, deposition of at least a portion of the one or more printing substances based on a determination made by the position module that the at least a portion of the print head is positioned over the second surface.

2. The handheld IT apparatus of claim 1, wherein said first surface characteristic is first surface structural variations of the first surface and the second surface characteristic is second surface structural variations of the second surface, and the position module is further configured to detect structural variations other than the first surface structural variations in the data.

3. The handheld IT apparatus of claim 2, wherein the multiple navigation sensors include one or more optical navigation sensors to provide a first image of the first surface showing the first surface structural variations of the first surface, and the position module is further configured to detect structural variations other than the first surface structural variations in a second image provided by the one or more optical navigation sensors.

4. The handheld IT apparatus of claim 3, wherein said one or more optical navigation sensors includes a first and a second optical sensor that are disposed at the print head.

5. The handheld IT apparatus of claim 4, further comprising a main housing coupled to the print head, and wherein said one or more optical navigation sensors further include a third optical sensor disposed at the main housing.

6. The handheld IT apparatus of claim 5, wherein said position module is further configured to determine a translation and a rotation of the apparatus relative to a reference location on the first surface using the third optical sensor.

7. The handheld IT apparatus of claim 6, wherein said position module is further configured to determine the reference location using the third optical sensor.

8. The handheld IT apparatus of claim 5, wherein said print head includes a plurality of nozzles disposed on a surface of the print head configured to deposit the one or more printing substances onto the first surface, the print head having a proximal end and a distal end opposite the proximal end, the proximal end being coupled to the main housing, the nozzles being disposed along the surface of the print head between the proximal and distal ends, and the first and the second optical sensor being disposed at the distal end of the print head adjacent to the nozzles and on opposite sides of the nozzles.

9. The handheld IT apparatus of claim 2, wherein the multiple navigation sensors further comprise one or more tactile sensors to provide the data.

10. The handheld IT apparatus of claim 1, wherein said print head comprises a plurality of nozzles configured to deposit the one or more printing substances, and said print module is further configured to control selected ones of the nozzles to suspend, at least temporarily, the deposition of the at least a portion of the one or more printing substances based on a determination made by the position module that the at least a portion of the print head is positioned over the second surface.

11. The handheld IT apparatus of claim 10, wherein the position module is further configured to, after determining that the at least a portion of the print head is positioned over the second surface, determine whether the at least a portion of the print head is back over the first surface, and wherein the print module is further configured to control the selected ones of the nozzles to resume the deposition of the at least a portion of the one or more printing substances based on a determination made by the position module that the at least a portion of the print head is back over the first surface.

12. The handheld IT apparatus of claim 1, wherein the position module is further configured to, after determining that at least a portion of the print head is positioned over the second surface, determine whether the at least a portion of the print head is back over the first surface, and wherein the print module is further configured to control the print head to resume deposition of the at least a portion of the one or more printing substances based on a determination made by the position module that the at least a portion of the print head is back over the first surface.

13. An apparatus, comprising:

means for depositing one or more printing substances onto a first surface;

means for receiving data indicating a first surface characteristic of the first surface, and for determining whether at least a portion of the means for depositing is positioned over a second surface having a second surface characteristic different from the first surface characteristic by detecting a characteristic other than the first surface characteristic as indicated by data received by the means for receiving; and means for controlling the means for depositing to deposit the one or more printing substances onto the first surface in accordance with image data received from an image source, and for suspending, at least temporarily, deposition of at least a portion of the one or more printing substances based on a determination made by the means for receiving and determining that the at least a portion of the means for depositing is positioned over the second surface.

14. The apparatus of claim 13, wherein said first surface characteristic is first surface structural variations of the first surface and the second characteristic is second surface structural variations of the second surface, and the means for receiving and determining detects structural variations other than the first surface structural variations in the data.

15. The apparatus of claim 14, further comprising means for providing images including a first image of the first surface showing the first surface structural variations of the first surface, and the means for receiving and determining detects structural variations other than the first surface structural variations in a second image provided by the means for providing images.

16. The apparatus of claim 13, wherein the means for receiving and determining is further for, after determining that at least a portion of the means for depositing is positioned over the second surface, determining whether the at least a portion of the means for depositing is back over the first surface; and the means for controlling the means for depositing is further for controlling the means for depositing to resume deposition of the at least a portion of the one or more printing substances based on a determination made by the means for receiving and determining that the at least a portion of the means for depositing is back over the first surface.

* * * * *